US011131128B2

(12) United States Patent
Porada

(10) Patent No.: US 11,131,128 B2
(45) Date of Patent: Sep. 28, 2021

(54) DOOR HANDLE ARRANGEMENT OF A MOTOR VEHICLE

(71) Applicant: HUF HÜLSBECK & FÜRST GMBH & CO. KG, Velbert (DE)

(72) Inventor: Martin Porada, Wuppertal (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 533 days.

(21) Appl. No.: 16/082,509

(22) PCT Filed: Jan. 26, 2017

(86) PCT No.: PCT/EP2017/051688
§ 371 (c)(1),
(2) Date: Sep. 5, 2018

(87) PCT Pub. No.: WO2017/153088
PCT Pub. Date: Sep. 14, 2017

(65) Prior Publication Data

US 2019/0112845 A1 Apr. 18, 2019

(30) Foreign Application Priority Data

Mar. 10, 2016 (DE) ..... 10 2016 104 372.9

(51) Int. Cl.
*E05B 85/10* (2014.01)
*E05B 81/90* (2014.01)
(Continued)

(52) U.S. Cl.
CPC ..... *E05B 85/107* (2013.01); *E05B 81/06* (2013.01); *E05B 81/90* (2013.01); *E05B 85/103* (2013.01); *E05B 79/06* (2013.01); *E05B 85/18* (2013.01)

(58) Field of Classification Search
CPC .... Y10S 292/31; E05B 85/103; E05B 85/107; E05B 81/90; E05B 79/06; E05B 85/18;
(Continued)

(56) References Cited

U.S. PATENT DOCUMENTS 2,599,054 A * 6/1952 Gates ..... E05B 5/003 292/348
2011/0148575 A1 6/2011 Sobecki et al.
2015/0039180 A9* 2/2015 Aerts ..... E05B 85/103 701/36

FOREIGN PATENT DOCUMENTS

DE 198 60 229 A1 7/2000
DE 10 2007 052 777 A1 5/2008
(Continued)

OTHER PUBLICATIONS

International Search Report of International Application No. PCT/EP2017/051688 dated Apr. 5, 2017, 6 pages.
(Continued)

*Primary Examiner* — Kristina R Fulton
*Assistant Examiner* — Emily G. Brown
(74) *Attorney, Agent, or Firm* — Fay Sharpe LLP

(57) ABSTRACT

A door handle arrangement for a motor vehicle includes a support, a handle which can take a basic position and an operating position, and a drive element which, during normal operation, moves the handle out of the basic position and into the operating position. The handle in its operating position can be grasped by an operator in order to open the door. In an emergency operation, the handle is designed to be movable manually into an emergency operating position in which it is pivoted about a first axis that is oriented transversely with respect to a longitudinal direction of the support. A first longitudinal portion of the handle is pivoted in the direction of the support and a second longitudinal
(Continued)

portion protrudes out of the door so as to be able to be grasped by an operator.

13 Claims, 5 Drawing Sheets

(51) Int. Cl.
*E05B 79/06* (2014.01)
*E05B 85/18* (2014.01)
*E05B 81/06* (2014.01)

(58) Field of Classification Search
CPC . E05B 81/06; E05B 85/10; E05B 5/00; E05B 5/003
See application file for complete search history.

(56) References Cited

FOREIGN PATENT DOCUMENTS

| | | | | |
|---|---|---|---|---|
| DE | 10 2011 009 524 | A1 | 7/2012 | |
| DE | 10 2013 212 198 | A1 | 1/2014 | |
| DE | 10 2013 112 706 | A1 | 5/2015 | |
| GB | 2 506 350 | A | 4/2014 | |
| WO | WO-2015074020 | A1 * | 5/2015 | ..... E05B 85/103 |
| WO | WO-2016113341 | A1 * | 7/2016 | ..... E05B 81/90 |

OTHER PUBLICATIONS

International Preliminary Report on Patentability of International Application No. PCT/EP2017/051688 dated Sep. 11, 2018 (and English Translation Thereof), 14 pages.

* cited by examiner

DOOR HANDLE ARRANGEMENT OF A MOTOR VEHICLE

BACKGROUND

The invention is directed at a door handle arrangement of a motor vehicle, having a support affixed on the inside on a door or hatch of the motor vehicle, a handle piece that can be activated to open the door or hatch, the handle piece having a cover side that is disposed strake-flush with the door or hatch in a basic position of the handle piece, and projecting out of the door or hatch in an operating position of the handle piece, and extending essentially parallel to the longitudinal direction of the support, and a drive element that is configured to move the handle piece out of its basic position into its operating position during normal operation, wherein the handle piece is disposed so that an operator can grasp it from behind in its operating position.

Such door handle arrangements for a motor vehicle can be structured as an interior or exterior handle, wherein the present invention relates to a door handle arrangement for an exterior handle. There are a great number of different designs and embodiments for such door handle arrangements. The implementation of a door handle according to the invention relates to such designs in which the handle support is disposed on the back side of the door, i.e. on the inside of the motor vehicle. The handle piece affixed to the handle support usually projects out of the door in such embodiments, and disrupts both the esthetic impression of the vehicle and the vehicle aerodynamics. In order to avoid these disadvantages, door handle arrangements are known from the state of the art, in which the outside of the handle piece runs approximately flush with the outer contour of the door, in other words strake-flush, in its basic position, in which it is not in use. Such a handle piece can be brought into an operating position to open the door or a latch on the vehicle side, in which position the handle piece projects relative to the outer contour of the door.

A door handle arrangement of the type indicated initially is known, for example, from DE 10 2011 009 524 A1. This known door handle arrangement has a handle piece that is disposed strake-flush in its basic position, and can be moved out of the basic position into an operating position, driven by a motor. Such a handle piece is preferably used in electric cars, in which the handle piece moves out of its strake-flush basic position, in which the handle piece is disposed to reduce air resistance, into the operating position, exclusively using an electrically operated drive, when an authorized user approaches the vehicle. As soon as the handle piece is no longer needed, it returns to the rest position and thereby disappears into the vehicle body, so as not to generate any air resistance. It is a disadvantage that in the case of a failure of the motor drive, the handle piece can no longer be moved, and that opening a door is almost impossible, and this is quite problematical for safety technology reasons. Independent of whether or not the vehicle is an electric vehicle, the problem can occur, in the case of strake-flush handle pieces, during winter, that the handle piece is frozen in place in its basic position, and the motor drive is not able or not designed to be strong enough to exert the necessary force to move the handle piece into the operating position.

The invention is based on the task of creating a solution that makes a door handle arrangement available, in simple manner, in terms of design, which arrangement is cost-effective in terms of its production, and in which the handle piece can be manually moved into the operating position even in the event of failure of the motor drive element, and activated to open the door.

BRIEF SUMMARY

In the case of a door handle arrangement of the type indicated initially, this task is accomplished, according to the invention, in that in the case of emergency operation due to failure of the drive element, the handle piece is configured so that it can be moved manually into an emergency operating position, wherein in the emergency operating position, the handle piece is disposed so that it can pivot about a first axle, which is configured to run transversely to the longitudinal direction of the support, in such a manner that a first longitudinal section of the handle piece is disposed to pivot in the direction of the support, and a second longitudinal section of the handle piece is disposed to project out of the door or hatch, so that an operator can grasp behind it. In this regard, the drive element is a motor-driven drive element. In the emergency operating position, the handle piece plunges into the door, at least in certain sections, with a first longitudinal section, whereas the second longitudinal section of the handle piece is pivoted away from the support. In this regard, the first axle is disposed between the longitudinal ends of the handle piece.

Advantageous and practical embodiments and further developments of the invention are evident from the dependent claims.

By means of the invention, a door handle arrangement of a motor vehicle is made available, which is characterized by a design in keeping with its function, and has a compact and cost-effective structure. In the door handle arrangement according to the invention, the special mounting of the handle piece ensures that the handle piece, which is disposed in strake-flush manner, can be pressed in the direction of the vehicle interior by a user during emergency operation, on a first longitudinal section, thereby pivoting the handle piece from its strake-flush basic position, about a first axle. When this happens, a second longitudinal section of the handle piece pivots out of the body of the vehicle and can be grasped by an operator, as long as the first longitudinal section of the handle piece is pressed in the direction of the vehicle interior. By grasping the second longitudinal section of the handle piece, the operator can then also pull the first longitudinal section of the handle piece out of the vehicle body, so that the handle piece is disposed in its operating position. In the operating position, the operator can then grasp behind the handle piece and preferably pivot it about an axle that runs transversely to the first axle, in order to activate a vehicle-side latch to open the door or hatch. With the door handle arrangement according to the invention, it is consequently possible to open the door or hatch of the vehicle purely manually, both in the event of failure of the electrical power supply and if a handle piece has become fixed in place due to ice formation. As a result, full functionality of the door handle arrangement exists even in an emergency, for example emergency operation without power, or a handle piece that has become frozen in place in its basic position, and nevertheless, a maximal degree of aerodynamic advantages is maintained during normal operation.

It has proven to be particularly advantageous, in terms of design, if a holding bracket can be attached to the door or hatch of the motor vehicle, on the inside, in an embodiment of the invention, wherein the holding bracket holds a second axle, so as to rotate, with which axle the support is connected in torque-proof manner, in such a manner that during activation by an operator, the handle piece can be disposed out of the operating position into an activation position pivoted about the second axle, in which the support is disposed pivoted relative to the holding bracket, to open the door or hatch. According to the invention, the handle piece is therefore not mounted directly so as to pivot. Instead, the handle piece can only be pivoted from the operating position into the activation position on the basis of the support that can be pivoted relative to the holding bracket, to open a door or hatch, and thereby the activation load of the handle piece is reduced, and the handle piece can be securely affixed to the handle support.

In order to ensure that in an emergency, pressing the first longitudinal section of the handle piece inward does not damage any components of the door handle arrangement that lie on the inside, the invention provides, in a further embodiment, that the holding bracket has a stop section configured in the shape of a trough, into which the handle piece can plunge with its first longitudinal section, at least in certain sections, during a movement into the emergency operating position, and against which the first longitudinal section of the handle piece disposed in its emergency operating position lies, at least in certain sections. In this manner, the inwardly directed movement of the first longitudinal section of the handle piece is limited and stops the first longitudinal section before it impacts components of the door handle arrangement.

In order to brake the last movement path of the handle piece from the basic position into the operating position during normal operation, so that the handle piece does not suddenly and noisily make contact in its operating position, the invention provides, in a further embodiment, that a delay element biased with a reset force is rotatably mounted on the holding bracket, and counteracts the movement of the handle piece out of the basic position into the operating position with its reset force, with a braking effect, during normal operation. In this regard, an attachment formed on the handle piece can make contact with the delay element, which attachment deflects the delay element counter to the reset force, thereby braking the handle piece in its movement, shortly before it reaches its operating position.

It has proven to be a particularly flexible design if, in an embodiment of the invention, the handle piece is connected with the support in such an articulated manner, by way of a coupling mechanism, that the handle piece is mounted on the support so as to move relative to it. In this way, it is guaranteed that the handle piece is moved relative to the support in a first step, during its movement out of the basic position into the operating position, and the support remains unmoved, whereas during the movement of the handle piece out of the operating position into the activation position, the handle piece remains on the support, unmoved, and the support pivots together with the handle piece, relative to the holder bracket, so as to open the door or hatch of the vehicle. The coupling mechanism is configured in such a manner that the handle piece can be moved rotationally (so as to rotate) about the first axle, and translationally relative to the support.

In this regard, an embodiment of the invention having a clever design provides that the coupling mechanism has a movement lever, of which a first longitudinal end is rotatably mounted on the support, by way of a rotation axle, and of which a second longitudinal end is rotatably connected with the first longitudinal section of the handle piece, by way of a coupling axle. In this manner, the handle piece can be pivoted relative to the support during emergency operation, and can be pressed in the direction of the support with its first longitudinal section, so that the second longitudinal section projects out of the vehicle body, so that it can be grasped by an operator, so that the handle piece as a whole can be pulled out of the vehicle body and disposed in its operating position, from which position a movement of the handle piece that is brought about manually by the operator, into the activation position, is possible to open the door or hatch.

During normal operation of the door handle arrangement, it is then provided, in a further embodiment of the invention, that the movement lever has an activation attachment on its first longitudinal end, on which the drive element engages during normal operation, and in doing so rotates the movement lever about the rotation axle in such a manner that the movement lever moves the handle piece out of the basic position into the operating position. The motor-driven drive element consequently does not act directly on the handle piece, but rather rotates the movement lever about the rotation axle by way of the activation attachment, and thereby the movement lever, which is coupled with the handle piece, forces the handle piece into the operating position.

To increase the functionality of the activation lever, it is provided, in a further embodiment of the invention, that the movement lever has a first lever section that has the first longitudinal end, and a second lever section that has the second longitudinal end, which sections are connected with one another by way of a connection axle, and can be rotated relative to one another only in one direction of rotation, at the connection axle. In this manner, the two-part movement lever acts as a single-part lever during normal operation, In order to implement the relative rotatability of the two lever sections of the movement lever, the invention provides, in a further embodiment, that the first lever section has a supporting attachment, which is configured on the longitudinal end of the first lever section that is connected with the connection axle, and that the second lever section has a supporting stop, which is configured on the longitudinal end of the second lever section that is connected with the connection axle, wherein the supporting attachment lies against the supporting stop during normal operation, during a movement of the handle piece out of the basic position into the operating position, and the first lever section and the second lever section jointly rotate about the connection axle.

In a further embodiment of the invention, it is provided that during emergency operation, the handle piece rotates the supporting attachment about the connection axle relative to the supporting stop in the case of a movement of the handle piece out of the basic position into the emergency operating position. The relative rotatability between the first and the second lever section gives the handle piece the degree of freedom that its first longitudinal section needs so that this section can be pressed inward into the vehicle body in the direction of the support, and the second longitudinal section can pivot out of the vehicle body.

It is particularly advantageous, in terms of design, in an embodiment of the invention, if the first axle is the coupling axle. As a result, components and construction space can be saved, and this increases the compactness of the door handle arrangement according to the invention.

For a controlled movement of the handle piece, independent of whether it is being moved in normal operation or emergency operation, the invention provides, in a further embodiment, that a guide lever that guides the second longitudinal end of the handle piece connects the handle piece with the support in articulated manner, wherein a first longitudinal end of the guide lever is rotatably mounted on a center section of the support, and a second longitudinal end of the guide lever is rotatably mounted on a center section of the handle piece.

In an embodiment of the door handle arrangement according to the invention, it is furthermore provided that a reset element that forces the handle piece at least out of its emergency operating position into its basic position engages on the first longitudinal end of the guide lever, which element rests on the support. If the handle piece is unintentionally moved manually into its emergency operating position by an operator, the reset element ensures, after the pressure force exerted by the user on the first longitudinal section has been eliminated, that the handle piece is moved back into the desired basic position, where it is disposed in strake-flush manner.

Finally, in a further advantageous embodiment, the invention provides that a guide rail that extends transversely to the longitudinal direction of the support and is guided in the direction of the first longitudinal section is configured on the second longitudinal section of the handle piece, which rail is guided in a guide recess configured on the support, transversely to its longitudinal direction, at least during a movement of the handle piece out of the basic position into the operating position. This embodiment supports that during normal operation, the handle piece is moved out of the vehicle body essentially transversely to the longitudinal direction of the support with its cover side. In the case of a movement of the handle piece into the emergency operating position, the guide rail comes out of the guide recess, since the second longitudinal section of the handle piece is pivoted relative to the support.

It is understood that the characteristics mentioned above and still to be explained below can be used not just in the combination indicated, in each instance, but also in other combinations or by themselves, without departing from the scope of the present invention. The scope of the invention is defined solely by the claims.

BRIEF DESCRIPTION OF THE DRAWINGS

Further details, characteristics, and advantages of the object of the invention are evident from the following description in connection with the drawing, in which a preferred exemplary embodiment of the invention is shown as an example. The drawing shows.

DETAILED DESCRIPTION

Figure 1:
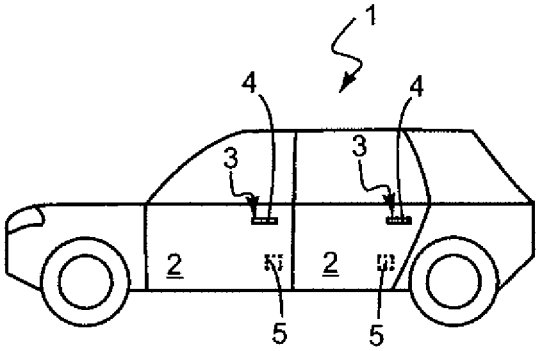
FIG. 1, a side view of a motor vehicle with multiple door handle arrangements according to the invention, FIG. 2, a perspective front view of a door handle arrangement according to the invention, FIG. 3, a perspective rear view of a door handle arrangement according to the invention, FIG. 4, a perspective view of a door indicated as an example, with a handle piece of the door handle arrangement according to the invention, disposed in strake-flush manner and in a basic position, FIG. 5, a side view of the door handle arrangement from FIG. 4, FIG. 6, a perspective view of the door indicated as an example, with the handle piece of the door handle arrangement according to the invention disposed in an operating position, FIG. 7, a side view of the door handle arrangement from FIG. 6, FIG. 8, a perspective view of the door indicated as an example, with the handle piece of the door handle arrangement according to the invention disposed in an activation position, FIG. 9, a side view of the door handle arrangement from FIG. 8, FIG. 10, a perspective view of the door indicated as an example, with the handle piece of the door handle arrangement according to the invention disposed in the emergency operating position, FIG. 11, a side view of the door handle arrangement from FIG. 10, FIG. 12, a perspective detail representation of the door handle arrangement according to the invention, FIG. 13, a further perspective detail representation of the door handle arrangement according to the invention, FIG. 14, a perspective view of a coupling mechanism of the door handle arrangement according to the invention, FIG. 15, a sectional representation of the door handle arrangement with the handle piece in its emergency operating position, FIG. 16, a detail view of the door handle arrangement according to the invention, FIG. 17, a perspective detail view of a delay element, with the handle piece disposed in the basic position, FIG. 18, a perspective detail view of the delay element, with the handle piece disposed in the operating position, FIG. 19, a perspective view of selected components of the door handle arrangement according to the invention, with the handle piece disposed in the basic position, FIG. 20, a further perspective view of selected components of the door handle arrangement according to the invention, with the handle piece disposed in the basic position, FIG. 21, yet another perspective view of selected components of the door handle arrangement according to the invention, with the handle piece disposed in the operating position, and FIG. 22, a final perspective view of selected components of the door handle arrangement according to the invention, with the handle piece disposed in the emergency operating position.

In FIG. 1, a vehicle, i.e. a motor vehicle 1 in the form of a passenger car is shown as an example; in the example, it has four doors 2 (two of which can be seen in FIG. 1), which doors can be opened by way of a door handle arrangement 3 and, in particular, using a door handle or a handle piece 4. The doors 2 are firmly latched by way of a respective latch 5, and can be opened from the outside only by way of a respective movement of the handle piece 4. This movement at the handle piece 4 can consist of a pulling movement and/or a flipping movement, wherein the corresponding movement of the handle piece 4 is transferred to the corresponding latch 5 by way of a Bowden cable system 6 (see FIG. 1) that is coupled with the movement of the handle piece 4, for example. The corresponding latch 5 and thereby the related door 2 can then be opened by means of the movement of the handle piece 4.

In FIGS. 2 to 22, the door handle arrangement 3 or selected components of the door handle arrangement 3 according to the present invention are shown in greater detail, in different views for different positions of the individual components relative to one another and for different operating cases, and this will be discussed in detail below.

Figure 2:
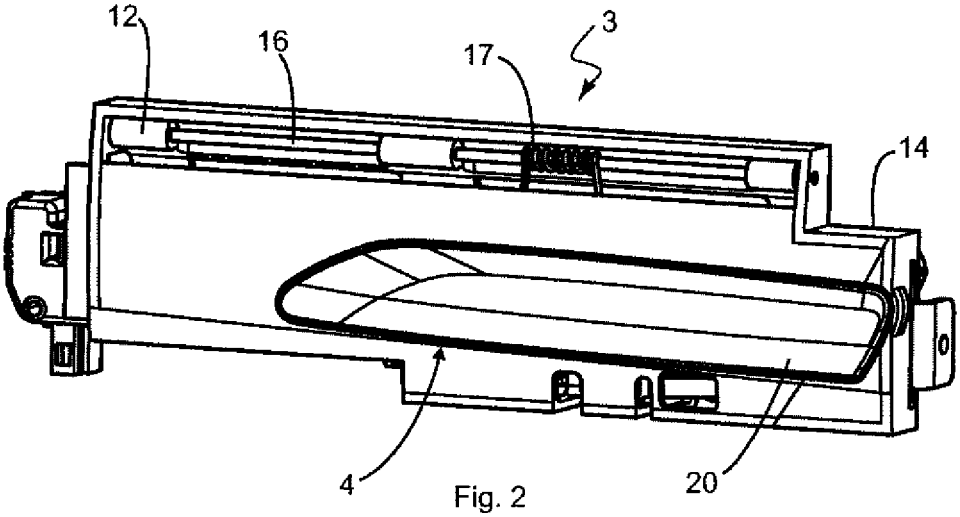
Figure 3:
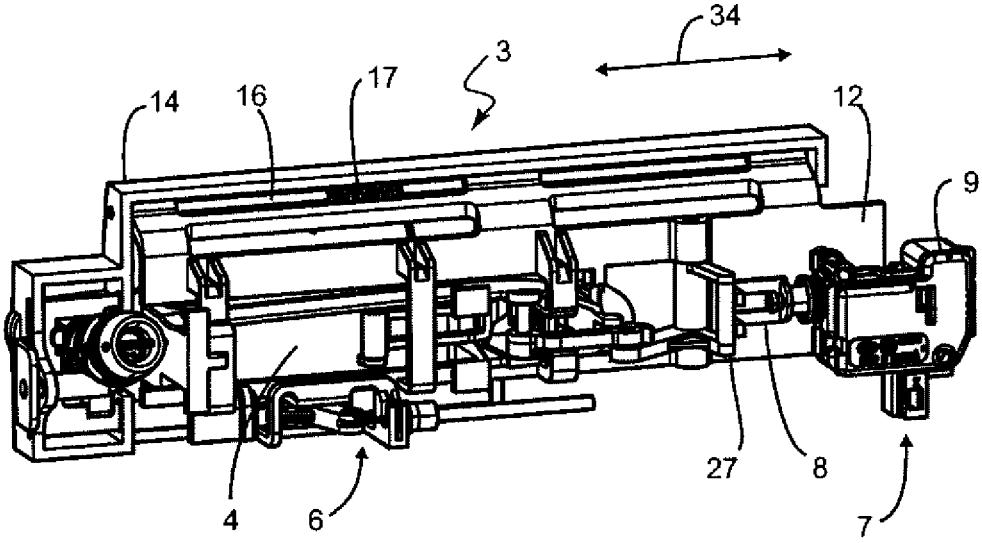
Figure 4:
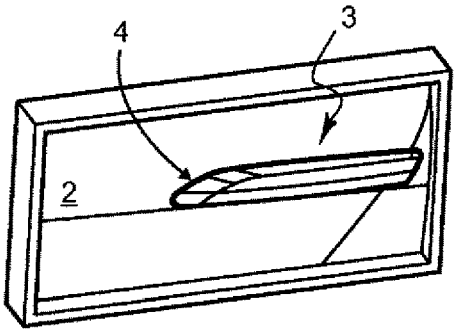
Figure 5:
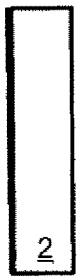
Figure 6:
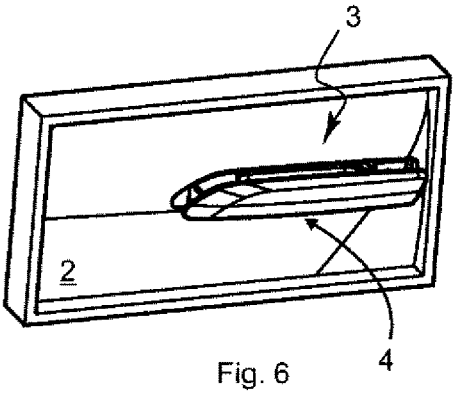
Figure 7:
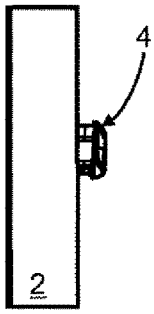
Figure 8:
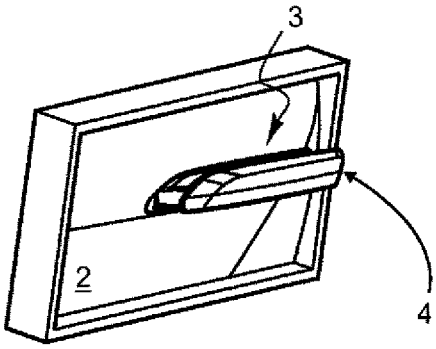
Figure 9:
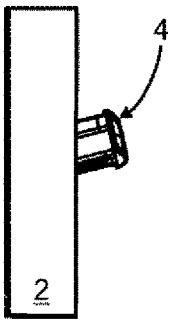
Figure 10:
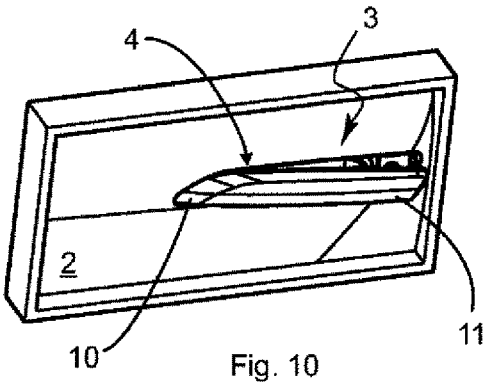
Figure 11:
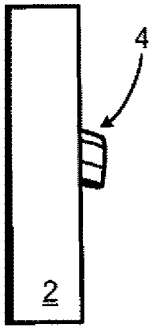
Figure 12:
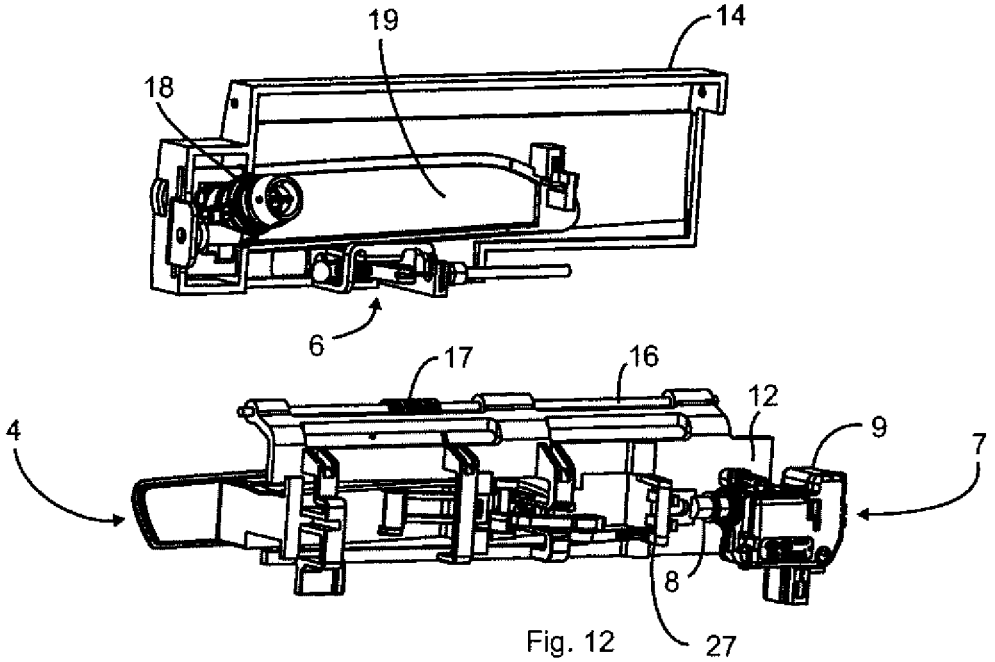

FIGS. 2 and 3 each show a perspective overall view of the door handle arrangement 3, wherein FIG. 2 represents a front view and FIG. 3 represents a rear view of the door handle arrangement 3. In FIGS. 4 to 11, different positions are then shown, which the handle piece 4 that serves to open the door 2 can assume, wherein the door 2 is shown merely as an example in the figures. In FIG. 4, the handle piece is disposed approximately flush with the outer contour of the door 2, in other words strake-flush, as is particularly clearly evident from the side view of FIG. 5, in which the handle piece 4 cannot be seen at all due to its strake-flush arrangement, i.e. it runs flush with the outer contour of the door 2. In this arrangement, the handle piece 4 is in a basic position in which it is not in use. From the basic position shown in FIGS. 4 and 5, the handle piece 4 can be moved into an operating position shown in FIGS. 6 and 7, in which the handle piece 4 projects relative to the outer contour of the door 2. Accordingly, the handle piece 4 is disposed projecting out of the door 2 in its operating position. In this projecting or moved-out operating position, an operator can activate or handle the handle piece 4 in order to open the door 2 or the vehicle-side latch 5. Handling of the handle piece 4 is a pulling movement performed by an operator in the exemplary embodiment shown. According to the present invention, moving the handle piece 4 out of the rest position shown in FIGS. 4 and 5 into the operating position shown in FIGS. 6 and 7 can take place either in power-driven normal operation, by means of a motor drive element 7, which is shown in FIG. 3 or 12, for example, or, in non-powered emergency operation in the event of failure of the drive element 7, by means of manual activation by the operator. The drive element 7 comprises an electric motor, for example, which moves a plunger 8 away from or toward the housing 9 of the drive element 7, so that the plunger 8 performs a linear movement, in order to ultimately move the handle piece 4 out of its basic position into the operating position, as will still be discussed below. The handle piece 4 can be grasped from behind by an operator in its operating position, in order to be activated to open the door. In FIGS. 8 and 9, the handle piece 4 is then disposed in an activation position. For this purpose, the handle piece 4 is pivoted upward out of the operating position with reference to FIGS. 8 and 9, in order to get into the activation position. During this movement of the handle piece 4 out of the operating position into the activation position, the Bowden cable system 6 is activated in order to act on the latch 5, so as to open the door 2. In FIGS. 10 and 11, the emergency operating position is shown, in which the handle piece 4 can be moved out of its basic position manually by an operator during emergency operation, in the event of failure of the drive element 7. For this purpose, the operator must press on a first longitudinal section 10 (see FIG. 10, for example) in the direction of the door 2, so that the first longitudinal section 10 is disposed within the door 2, at least in certain sections. For this reason, the first longitudinal section 10 of the handle piece 4 practically cannot be seen in the side view of FIG. 11. Since the handle piece 4 can be rotated, among other things, about a first axle 15, which will still be described in greater detail below, a second longitudinal section 11 (see FIG. 10, for example) of the handle piece 4 gets into a position projecting out of the door 2, as the result of the longitudinal section 10 being pressed in, in which position an operator can grasp behind the second longitudinal section 11 in order to manually move the first longitudinal section 10 and thereby the entire handle piece 4 into the activation position. From the operating position assumed in this manner, the handle piece 4 can then be pivoted (as is usual and has been described above for normal operation) into the activation position by an operator, even during emergency operation, in order to open the door 2 of the vehicle 1 by acting on the latch 5. In emergency operation, the handle piece 4 is consequently moved manually by an operator, whereby the handle piece 4 is first moved out of the basic position (see FIGS. 4 and 5) by pressing the first longitudinal section 10 of the handle piece 4 inward, into the emergency position (see FIGS. 10 and 11), whereupon the operator can grasp behind the second longitudinal section 11 of the handle piece 4, in order to move the first longitudinal section 10 and thereby the complete handle piece 4 into the operating position. From the operating position (see FIGS. 6 and 7), the handle piece 4 is then pivoted into the activation position (see FIGS. 8 and 9). In the following, the structure of the door handle arrangement 3 will be explained, which structure allows handling of the handle piece 4 as described above.

As can be seen in FIGS. 2, 3, 12, and 13, for example, the door handle arrangement 3 has a support 12 that is affixed on the inside of the door 2 of the motor vehicle 1. In contrast to the state of the art, however, the support 12 is not directly attached to the door 2. According to the present invention, the support 12 is affixed to the door 2 by way of a holding bracket 14. The holding bracket 14 itself is attached on the inside of the door 2 and thereby disposed on the door 2 in locally fixed manner. In this regard, a second axle 16 is rotatably mounted by the holding bracket 14. Support 12 is connected with this second axle 16 in a non-rotatable manner. The rotatable mounting of the support 12 on the holding bracket 14, by way of the second axle 16, allows a relative movement between the support 12 and the holding bracket 14, which can be locally affixed on the door 2, wherein a reset spring 17 wound around the second axle 16 supports itself on the holding bracket 16 and the support 12, so that the support 12 is mounted so as to pivot relative to the holding bracket 14, which holds an emergency closing cylinder 18, counter to the force of the reset spring 17. The mounting bracket 14 has a passage opening 19 (see FIG. 12, for example), by means of which the handle piece 4 is connected, from the outside of the door 2, with the support 12 disposed on the inside of the door 2, during assembly. In this regard, the representation in FIG. 12 is misleading, since the handle piece 4, which has a cover side 20, is not pre-assembled together with the support 12 before the support 12 is mounted in the holding bracket 14. Instead, it is shown in FIG. 12 that the support 12 forms a module together with the handle piece 4, wherein this module can be pivoted relative to the holding bracket 14, about the second axle 16. In this regard, the cover side 20 (see FIG. 2, for example) of the handle piece 4 covers the passage opening 19 when the handle piece 4 is disposed on the basic position.

The handle piece 4 itself is mounted on the support 12 so that it can move relative to the latter. For this purpose, the handle piece 4 is connected with the support 12 in articulated manner by way of a coupling mechanism 21 (see FIG. 13, for example). The coupling mechanism 21 comprises a movement lever 22, of which a first longitudinal end 23 is rotatably mounted on the support 12, by way of a rotation axle 24, and of which a second longitudinal end 25 is rotatably connected with the first longitudinal section 10 of the handle piece 4 by way of a coupling axle 26. The connection of the handle piece 4 with the support 12 is shown using the broken lines in FIG. 13. At its first longitudinal end 23, the movement lever 22 has an activation attachment 27 (see FIGS. 3 and 14, for example), on which the drive element 7 engages during normal operation. To state it more precisely, in normal operation the plunger 8 of the drive element 7 presses against the activation attachment 27, thereby causing the movement lever 22 to rotate about the rotation axle 24 (see arrow 28 in FIG. 21), thereby causing the handle piece to get out of the basic position (see FIGS. 19 and 20, for example) into the operating position (see FIG. 21, for example), whereby the movement lever 22 moves the handle piece 4 out of the basic position into the operating position, and the support 12 is disposed not pivoted relative to the holding bracket 14.

Figure 13:
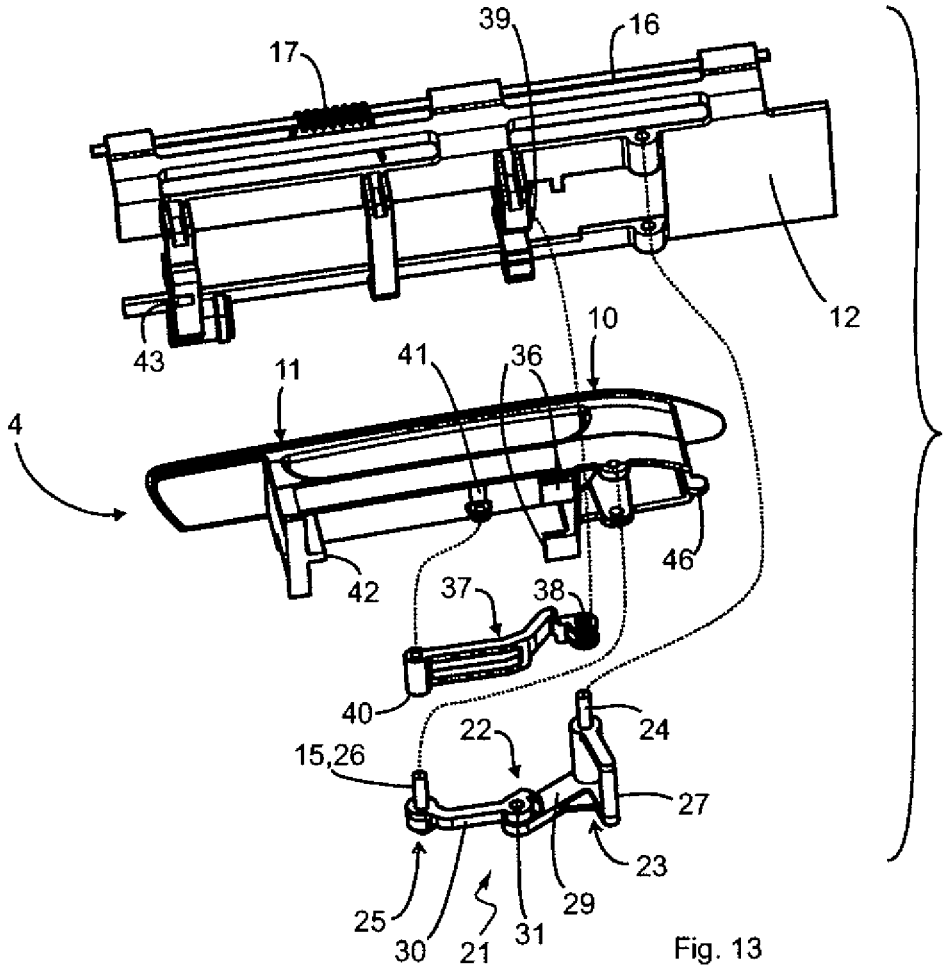
Figure 14:
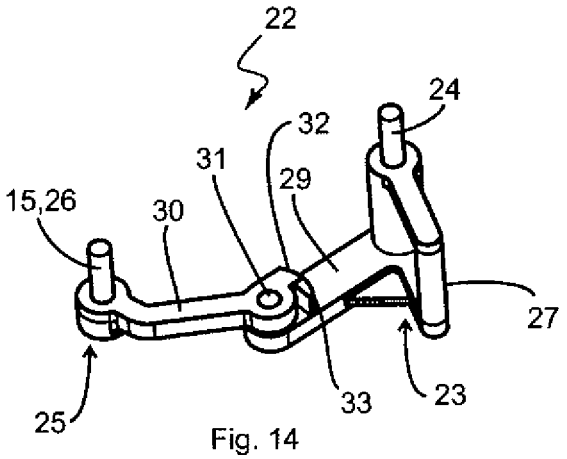
Figure 20:
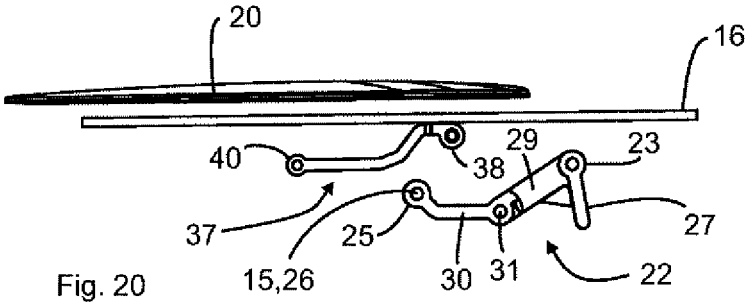
Figure 21:
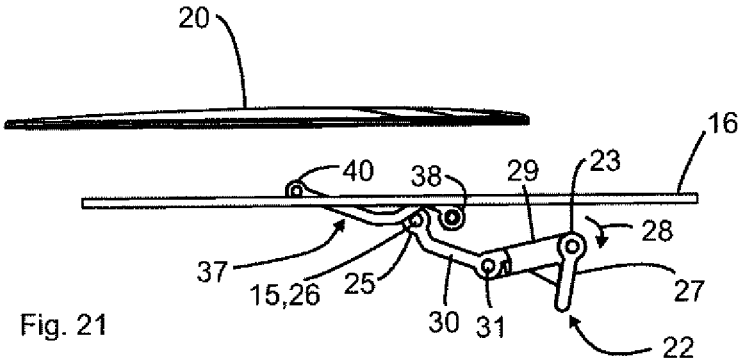

As can furthermore be seen in FIGS. 13 and 14, the movement lever 22 comprises a first lever section 29 that has the first longitudinal end 23, and a second lever section 30 that has the second longitudinal end 25. In this regard, the first lever section 29 and the second lever section 30 are connected with one another by way of a connection axle 31. During a movement of the handle piece 4 out of the basic position into the operating position, which takes place during normal operation, the first lever section 29 and the second lever section 30 act as being rigidly connected with one another, and jointly rotate about the rotation axle 24, without any relative rotation taking place between the two lever sections 29 and 30 about the connection axle 31. This is possible because the first lever section 29 and the second lever section 30 are connected so that they can rotate relative to one another only in one rotation direction, which is directed counter to the rotation direction 28 of the activation attachment 27 during normal operation, by way of the connection axle 31. In order to implement this, the first lever section 29 has a support attachment 32, which is formed at the longitudinal end of the first lever section 29 that is connected with the connection axle 31, the second lever section 30 having a support attachment stop 33, which is formed at the longitudinal end of the second lever section 30 that is connected with the connection axle 31 (see FIG. 14, for example). In normal operation, during a movement of the handle piece 4 out of the basic position into the operating position, the support attachment 32 lies against the support stop 33, and thereby the first lever section 29 and the second lever section 30 rotate jointly about the connection axle 31. This movement process in normal operation, in which the handle piece 4 is moved out of the basic position into the operating position using the drive element 7, is shown in FIGS. 20 and 21. During the movement of the handle piece 4 into its operating position, two driver arms 36 formed on the handle piece 4 (see FIG. 13, for example) make contact with the support 12, so that manual activation by the operator pivots the handle piece 4 and thereby the support 12 about the second axle 16. The rotatable mounting of the support 12 on the holding bracket 14, by way of the second axle 16, consequently brings about the result, in this regard, that during activation by the operator, the handle piece 4 can be disposed out of the operating position into an activation position, in which it is pivoted about the second axle 16, to open the door 2.

Figure 22:
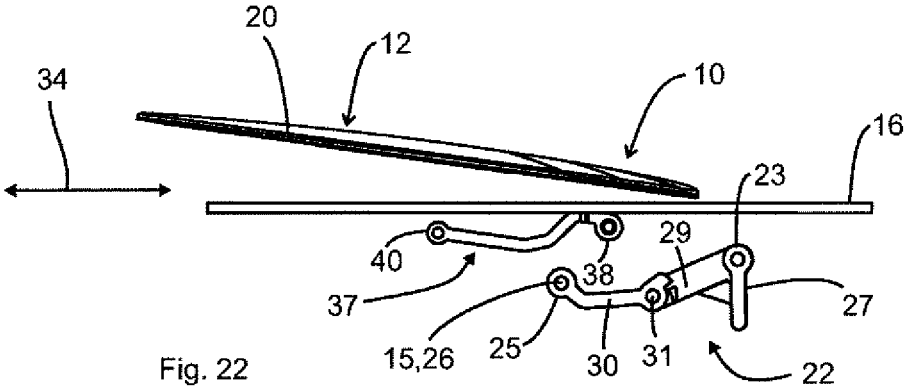

In emergency operation, the handle piece is moved manually by an operator, out of the basic position shown in FIG. 20 into the emergency operating position shown in FIG. 22, whereby here, the handle piece 4 rotates the support attachment 32 about the connection axle 31, relative to the support stop 33, when the first longitudinal end 10 of the handle piece 4 is manually pressed in the direction of the support 12 or of the second axle 16 by the operator, which axle extends in the longitudinal direction 34 of the support 12, as can be seen in FIG. 22. In other words, during emergency operation, if the drive element 7 fails, the handle piece 4 is configured so that it can be moved manually into an emergency operating position. In this regard, the emergency operating position is characterized in that the handle piece 4 is disposed pivoted about the first axle 15, which is configured to run transversely to the longitudinal direction 34 of the support 12, in such a manner that the first longitudinal section 10 of the handle piece 4 is disposed pivoted in the direction of the support 12, and the second longitudinal section 11 of the handle piece 4 is disposed so that an operator can grasp behind it. As is evident from the figures, in the exemplary embodiment shown, the first axle 15 is simultaneously also the coupling axle 26.

Figure 15:
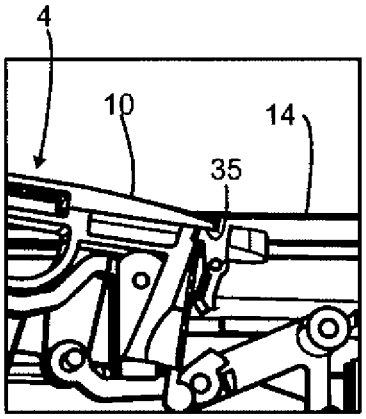

So that the handle piece 4 cannot be pressed infinitely into the door 2 with its first longitudinal section 10, the holding bracket 14 has a stop section 35 configured in the form of a trough. During a movement into the emergency operating position, the handle piece 4 plunges into this stop section 35 with its first longitudinal section 10, at least in certain sections, as shown in FIG. 15. Consequently, when the handle piece 4 is disposed in its emergency operating position, then the first longitudinal section 10 of the handle piece 4 lies against the stop section 35 at least in certain sections, and thereby the movement of the handle piece 4 directed inward into the door 2, i.e. in the direction of the support 12, is limited.

In order to restrict the freedom of movement of the handle piece 4 and, in particular, of the second longitudinal section 11, a guide lever 37 (see FIG. 13, for example) is provided, which guides the second longitudinal end 11 of the handle piece 4. The guide lever 37 ensures an articulated connection of handle piece 4 and support. In this regard, a first longitudinal end 38 of the guide lever 37 is rotatably mounted on a center section 39 of the support 12, wherein a second longitudinal end 40 of the guide lever 37 is rotatably mounted on a center section 41 of the handle piece 4, as can be seen in FIG. 13, for example, where the broken lines indicate the mounting of the handle piece 4 on the support 12. The guidance of the handle piece 4 during its movement out of the basic position into the operating position is furthermore supported in that a guide rail 42 that extends transversely to the longitudinal direction 34 of the support 12 and is directed in the direction of the first longitudinal section 10 is configured on the second longitudinal section 11 of the handle piece 4, as can be seen in FIG. 13. During a movement of the handle piece 4 out of the basic position into the operating position, the guide rail 42 is guided in a guide recess 43 (see also FIG. 13), which is formed on the support 12 transversely to its longitudinal direction 34. During the pivoting movement of the handle piece 4 about the first axle 15, during a movement into the emergency operating position, the guide rail 42 comes out of the guide recess 43, since otherwise, pivoting of the handle piece 4 about the first axle 15 would not be possible at all.

Figure 17:
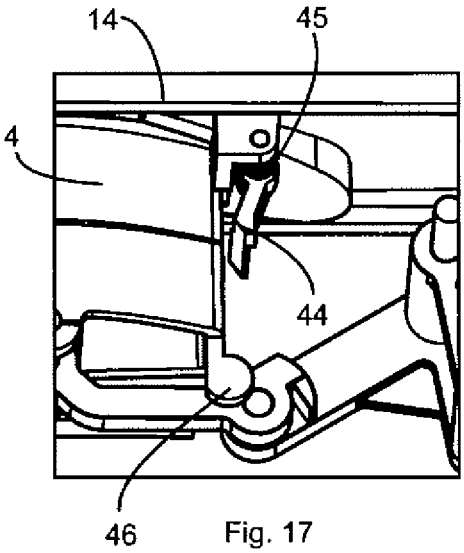
Figure 18:
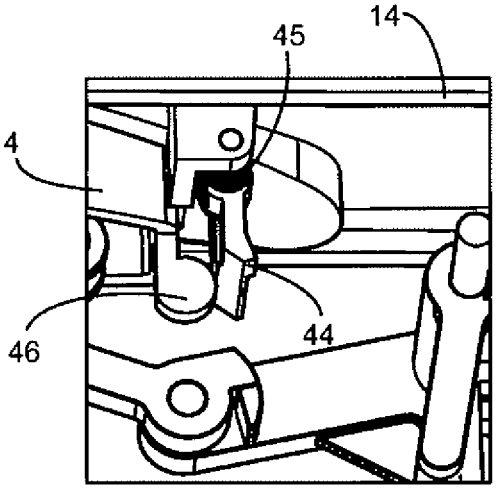
Figure 19:
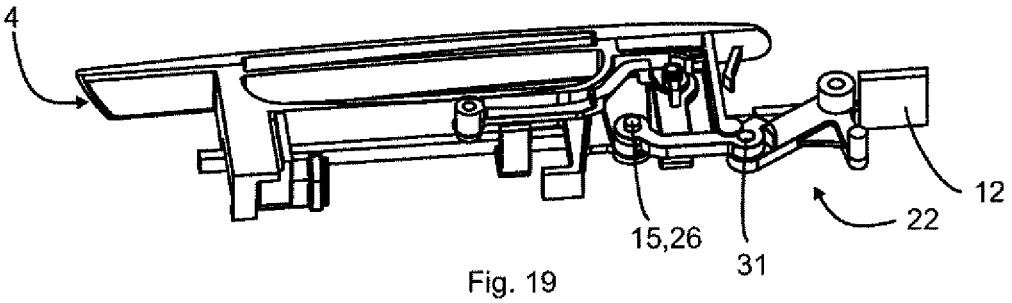

So that the driver attachments 36 of the handle piece 4 do not make contact with the support 12 during the movement of the handle piece 4 out of the basic position into the operating position 4, during normal operation, causing noise, a delay element 44 (see FIGS. 17 and 18, for example) is provided, which is rotatably mounted on the holding bracket 14. The delay element 44 is biased by means of a spring element 45, with the spring element 45 applying a type of reset force. In normal operation, the delay element 44 counteracts the movement of the handle piece 4 out of the basic position into the operating position, braking it with its reset force, in that the delay element 44 makes contact with a braking attachment 46 that is formed on the handle piece 4. In FIG. 17, the basic position is shown, in which the delay element 44 is disposed inactivated. In contrast, in FIG. 18 the braking attachment 46 of the handle piece 4 makes contact with the delay element 45 and rotates it, counter to the reset force of the spring element 45, about the axle about which the spring element 45 is wound, thereby braking the moving-out movement of the handle piece 4.

Figure 16:
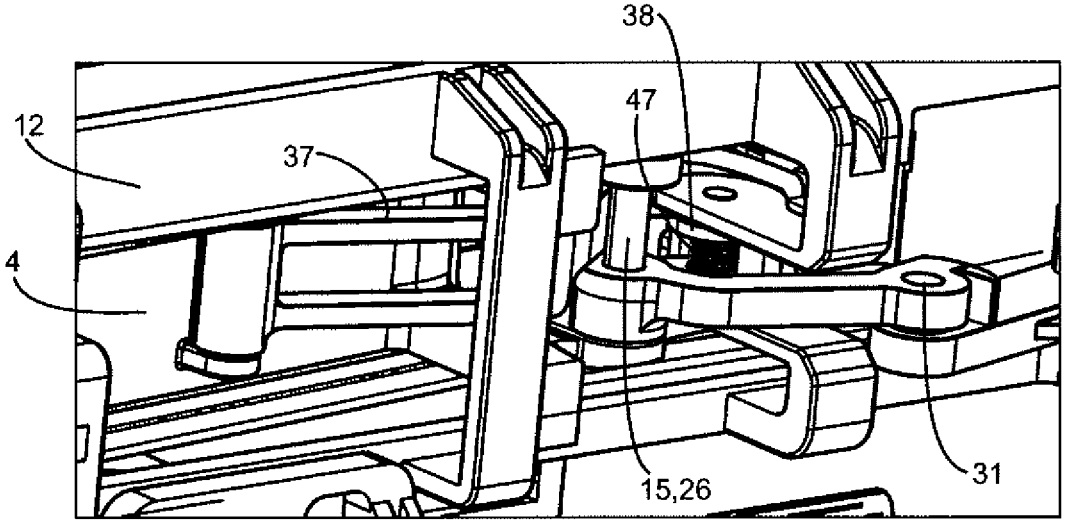

In order to prevent the handle piece 4 from accidentally getting into its emergency operating position, a reset element 47 that forces the handle piece 4 out of its emergency operating position into its basic position engages on the first longitudinal end 38 of the guide lever 37, as shown in FIG. 16. The reset element 47 supports itself on the support 12 and ensures resetting of the handle piece 4 out of the emergency operating position into the basic position after a pressure force exerted by an operator on the first longitudinal section 10 of the handle piece 4 has been taken away.

In conclusion, the method of functioning of the door handle arrangement 3 according to the invention will be briefly explained once again, using FIGS. 20 to 22, where it should be noted that in FIGS. 20 to 22, for reasons of clarity only the cover side 20 of the handle piece 4, the movement lever 22, the guide lever 37, and the second axle 16 are shown. FIGS. 20 to 22 are top views of the aforementioned components of the door handle arrangement 3 and show the basic position (see FIG. 20), the operating position (see FIG. 21), and the emergency operating position (see FIG. 22). In FIGS. 20 to 22, solely the second axle 16 is disposed fixed in place relative to the other components shown in these figures. The cover side 20 of the handle piece 4, the movement lever 22, and the guide lever 37 are affixed to the support 12 in articulated manner, and connected with the handle piece 4 in articulated manner, whereby the support 12 is mounted on the holding bracket 14, on which the second axle 16 is rotatably mounted, so as to pivot on this bracket. In FIG. 20, the handle piece 4 is disposed in its basic position, in which the cover side 20 runs strake-flush with the door 2. In normal operation, the plunger 8 of the drive element 7 presses against the activation attachment 27 of the movement lever 22 and rotates the movement lever 22 clockwise about the rotation axle 24 at its first longitudinal end 23, so that the operating position of the handle piece 4 shown in FIG. 21 is assumed. In this regard, the two-part movement lever 22 moves as a rigid lever, because during this rotational movement, the support attachment 32 lies against the support stop 33. During a movement of the handle piece 4 in normal operation, the drive element 7 consequently engages on the first longitudinal end 23 of the movement lever 22 and pivots the movement lever 22 at the first longitudinal end 23. During the movement of the handle piece 4 out of the basic position into the operating position, the second longitudinal end 25 of the movement lever 22 moves in the direction of the second axle 16. The pivoting movement of the movement lever 22 is transferred to the guide lever 37, so that the latter also pivots clockwise about its first longitudinal end 38, thereby causing the second longitudinal end 40 of the guide lever 37 to move the handle piece 4 out of the door 2. During emergency operation (see FIG. 22), the handle piece 4 is pressed in the direction of the second axle 16, i.e. inward into the door panel, in the direction of the support 12, at its first longitudinal section 10. Because of the degree of freedom that results from the connection axle 31 on the two-part movement lever 22, the handle piece 4 can only be moved in the direction of the second axle 16 by an operator, with the second longitudinal end 25 rotating counterclockwise and the lever section 30 rotating relative to the first lever section 29 of the movement lever 22. By means of pivoting the first longitudinal section 10 of the handle piece 4 inward about a rotation point that lies between the longitudinal ends of the cover side 20, the second longitudinal section 12 pivots away from the second axle and can be grasped from behind by an operator, so that the operator can grasp the handle piece 4 at the second longitudinal end 12 in an emergency, and move it into the operating position, in which opening the door by means of a movement of the handle piece 4 into the activation position is possible. In this regard, the handle piece 4 primarily rotates about the first axle 15, i.e. about the coupling axle 26 of the movement lever 22, during its movement out of the basic position into the emergency operating position.

In summary, a door handle arrangement 3 has been described above, in which the handle piece 4 is moved out of its strake-flush basic position during electrically operated normal operation, and thereby a user can activate the handle piece 4 so as to act on the latch 5 to open the door 2. The door handle arrangement 3 is characterized by its mechanical redundancy, in which, during emergency operation in the case of failure of the drive element 7, the handle piece 4 is configured so that it can be manually moved into an emergency operating position in the case of non-powered emergency operation, whereby the handle piece 4 is disposed so that it can be pivoted about the first axle 15, which is configured to run transversely to the longitudinal direction 34 of the support 12 in the emergency operating position, in such a manner that the first longitudinal section 10 of the handle piece 4 is disposed to pivot in the direction of the support 12, and a second longitudinal section 11 of the handle piece 4 is disposed projecting out of the door 2 or moved away from the support 12, and so that an operator can grasp behind it, so that the operator can move the handle piece 4 into the operating position, from which the handle piece 4 can then be moved into the activation position to open the door 2. For the door handle arrangement 3 according to the invention, it is characteristic that the handle piece 4, the coupling mechanism 21, which mounts the handle piece 4 on the support 12 in articulated manner, and the drive element 7 are affixed and mounted on the support 12, so that these components, together with the support 12, form a component group that can be pivoted jointly relative to the holding bracket 14, about the second axle 16, which is rotatably mounted on the holding bracket 14, which is attached to the door 2 in a fixed location, when the handle piece 4 is activated by an operator, when the handle piece is supposed to be moved from its operating position into its activation position. In this regard, the handle piece is mounted on the support 12 transversely to the second axle 16 and translationally movable relative to the support 12, by way of the coupling mechanism 21, when the handle piece 4 moves out of its basic position into the operating position. In addition, however, the handle piece 4 can also be moved rotationally about the first axle 15, relative to the support 12, when the handle piece 4 is moved out of the basic position into the emergency operating position by an operator in emergency operation, whereby the operator then can move the handle piece 4 out of the emergency operating position into the operating position, out of which the handle piece 4 can then be moved into the activation position to open the door 2.

The invention described above is, of course, not restricted to the embodiment that has been described and is shown. It is evident that numerous changes, obvious to a person skilled in the art in accordance with the intended use, can be made in the embodiment shown in the drawing, without thereby departing from the scope of the invention. A person skilled in the art will recognize that the door handle arrangement 3 according to the invention can be used not just for a door 2, but rather also a hatch or a lid of a motor vehicle. Everything contained in the description and/or shown in the drawing belongs to the invention, including whatever is obvious to a person skilled in the art in deviation from the concrete exemplary embodiment.

The invention claimed is:

1. A door handle arrangement of a motor vehicle comprising:

a support affixed on the inside of a door or hatch of the motor vehicle, a handle piece that can be activated to open the door or hatch, including a cover side that is disposed strake-flush with the door or hatch in a basic position of the handle piece, and projecting out of the door or hatch in an operating position of the handle piece, and extending essentially parallel to a longitudinal direction of the support, and a drive element that is configured to move the handle piece out of its basic position into its operating position during normal operation, wherein the handle piece is disposed so that an operator can grasp it from behind in its operating position, wherein in emergency operation due to failure of the drive element, the handle piece is configured so that it can be moved manually into an emergency operating position, wherein in the emergency operating position, the handle piece is disposed so that it can pivot about a first axle, which is configured to run transversely to the longitudinal direction of the support, in such a manner that a first longitudinal section of the handle piece is disposed to pivot in the direction of the support, and a second longitudinal section of the handle piece is disposed to project out of the door or hatch, so that an operator can grasp behind it, and wherein a holding bracket is attached to the inside of the door or hatch of the motor vehicle, wherein the holding bracket rotatably supports a second axle, wherein the second axle is non-rotatably connected to the support in such a manner that during activation by an operator, the handle piece is disposed out of the operating position into an activation position pivoted about the second axle, in which the support is disposed pivoted relative to the holding bracket, to open the door or hatch.

2. The door handle arrangement according to claim 1, wherein the holding bracket has a stop section configured in the shape of a trough, into which the handle piece can be at least partially immersed with its first longitudinal section during a movement into the emergency operating position, and against which the first longitudinal section of the handle piece is disposed in its emergency operating position lies, at least in certain sections.

3. The door handle arrangement according to claim 1, wherein a delay element biased with a reset force is rotatably mounted on the holding bracket, and counteracts the movement of the handle piece out of the basic position into the operating position with its reset force, with a braking effect, during normal operation.

4. The door handle arrangement according to claim 1, wherein the handle piece is connected with the support in such an articulated manner, by way of a coupling mechanism, that the handle piece is mounted on the support so as to move relative to it.

5. The door handle arrangement according to claim 4, wherein the coupling mechanism has a movement lever, of which a first longitudinal end is rotatably mounted on the support, by way of a rotation axle, and of which a second longitudinal end is rotatably connected with the first longitudinal section of the handle piece, by way of the first axle.

6. The door handle arrangement according to claim 5, wherein the movement lever has an activation attachment on its first longitudinal end, wherein the drive element engages on the activation attachment during normal operation, and in doing so the drive element rotates the movement lever about the rotation axle in such a manner that the movement lever moves the handle piece out of the basic position into the operating position.

7. The door handle arrangement according to claim 5, wherein the movement lever has a first lever section that has the first longitudinal end and a second lever section that has the second longitudinal end, which sections are connected with one another by way of a connection axle, and can be rotated relative to one another only in one direction of rotation at the connection axle.

8. The door handle arrangement according to claim 7, wherein the first lever section has a first support stop, which is formed at a longitudinal end of the first lever section that is connected with the connection axle, and that the second lever section has a second support stop, which is formed at a longitudinal end of the second lever section that is connected with the connection axle, wherein in normal operation, during a movement of the handle piece out of the basic position into the operating position, the first support stop of the first lever section lies against the second support stop of the second lever section, and the first lever section and the second lever section rotate together about the rotation axle.

9. The door handle arrangement according to claim 8, wherein in emergency operation, during a movement of the handle piece out of the basic position into the emergency operating position, the handle piece rotates the support attachment about the connection axle relative to the support stop.

10. The door handle arrangement according to claim 5, wherein the first axle is a coupling axle.

11. The door handle arrangement according to claim 1, wherein a guide lever that guides a second longitudinal end of the handle piece connects the handle piece with the support in articulated manner, wherein a first longitudinal end of the guide lever is rotatably mounted on a center section of the support, and a second longitudinal end of the guide lever is rotatably mounted on a center section of the handle piece.

12. The door handle arrangement according to claim 11, wherein a reset element that forces the handle piece at least out of its emergency operating position into its basic position engages on the first longitudinal end of the guide lever, wherein the reset element rests on the support.

13. The door handle arrangement according to claim 1, wherein a guide rail that extends transversely to the longitudinal direction of the support and is guided in the direction of the first longitudinal section is configured on the second longitudinal section of the handle piece, wherein the guide rail is guided in a guide recess configured on the support, transversely to the longitudinal direction of the support, at least during a movement of the handle piece out of the basic position into the operating position.

* * * * *